US009255429B2

(12) United States Patent
Kim et al.

(10) Patent No.: US 9,255,429 B2
(45) Date of Patent: Feb. 9, 2016

(54) 2-STEP GUIDE HOOD LATCH APPARATUS FOR VEHICLE

(71) Applicants: Hyundai Motor Company, Seoul (KR); Kia Motors Corporation, Seoul (KR)

(72) Inventors: Sang Il Kim, Hwaseong-si (KR); Chang Gi Ha, Hwaseong-si (KR); C H Jung, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 13/679,307

(22) Filed: Nov. 16, 2012

(65) Prior Publication Data

US 2014/0054903 A1 Feb. 27, 2014

(30) Foreign Application Priority Data

Aug. 24, 2012 (KR) ..... 10-2012-0092809

(51) Int. Cl.

| | |
|---|---|
| ***E05C 19/10*** | (2006.01) |
| ***E05B 83/24*** | (2014.01) |
| *E05C 3/06* | (2006.01) |
| *E05C 3/16* | (2006.01) |
| *E05B 83/18* | (2014.01) |

(52) U.S. Cl.

CPC ..... *E05B 83/24* (2013.01); *E05B 83/18* (2013.01); *E05B 83/243* (2013.01); *Y10S 292/14* (2013.01); *Y10T 292/0945* (2015.04)

(58) Field of Classification Search

CPC ..... Y10S 292/14; E05B 83/243; E05B 83/18; E05B 83/24; Y10T 292/0945

USPC ..... 292/96, 216, 95, 304, DIG. 14, 201, 210

See application file for complete search history.

(56) References Cited

U.S. PATENT DOCUMENTS

| | | | | |
|---|---|---|---|---|
| 1,758,988 | A * | 5/1930 | Turnwald | E05B 83/243 292/25 |
| 2,246,787 | A * | 6/1941 | Dall | E05B 83/16 292/108 |
| 2,246,789 | A * | 6/1941 | Dall | E05B 83/16 292/117 |

(Continued)

FOREIGN PATENT DOCUMENTS

| | | | | |
|---|---|---|---|---|
| DE | 10357285 | A1 * | 7/2005 | E05B 83/24 |
| DE | 102005052836 | A1 * | 5/2006 | E05B 83/24 |

(Continued)

*Primary Examiner* — Kristina Fulton
*Assistant Examiner* — Faria Ahmad
(74) *Attorney, Agent, or Firm* — Morgan, Lewis & Bockius LLP

(57) ABSTRACT

A 2-step guide hood latch apparatus for a vehicle is provided, which by removing a conventional safety lever, a driver can open a hood merely with two times of manipulation of a release handle indoors without going out of the vehicle, thereby solving the conventional inconvenience of having to put the hand into the hood and manipulate the safety lever. To this end, the 2-step guide hood latch apparatus includes a pawl rotatably mounted on a base plate, a claw rotatably mounted on the base plate in such a way to be held with the pawl, and a guide lever, an end portion of which is hinge-coupled to the pawl by a hinge structure, and a center portion and the other end portion of which are coupled to the claw to induce 1-step lock and 2-step lock states of the claw, in which a hood is opened merely with manipulation of a release lever inside a vehicle.

5 Claims, 6 Drawing Sheets

(56) References Cited

U.S. PATENT DOCUMENTS 2,246,793 A * 6/1941 Dall ..... E05B 83/16 292/11
2,246,794 A * 6/1941 Dall ..... E05B 83/16 292/11
2,256,465 A * 9/1941 Brubaker ..... E05B 83/16 292/198
2,268,741 A * 1/1942 Dall ..... E05B 83/24 292/117
2,286,465 A * 6/1942 Clement ..... B65D 3/28 229/160.2
2,507,196 A * 5/1950 Dall ..... E05B 83/16 292/108
2,777,721 A * 1/1957 Burke ..... E05B 65/0046 292/216
2,797,116 A * 6/1957 Jaster ..... E05B 83/24 292/11
2,877,038 A * 3/1959 Kramer ..... E05B 83/16 292/216
3,397,906 A * 8/1968 Beckman ..... E05B 83/16 292/108
3,565,476 A * 2/1971 Berman ..... E05B 47/0607 292/11
3,905,624 A * 9/1975 Fujita ..... E05B 83/16 292/11
4,045,064 A * 8/1977 Okada ..... E05B 83/16 292/125
4,917,420 A * 4/1990 Rogers, Jr. ..... E05B 83/16 292/198
4,936,611 A * 6/1990 Palvolgyi ..... E05B 83/16 292/216
4,974,885 A * 12/1990 Yokoyama ..... E05B 81/20 292/201
4,991,884 A * 2/1991 Cairns ..... E05B 83/24 292/28
5,048,877 A * 9/1991 Rogers, Jr. ..... E05B 83/24 292/110
5,148,691 A * 9/1992 Wallden ..... E05B 47/0012 292/201
5,154,457 A * 10/1992 Watanabe ..... E05B 85/243 292/201
5,154,460 A * 10/1992 Bartsch ..... E05B 83/36 292/216
5,273,325 A * 12/1993 Zimmermann ..... E05B 81/22 292/216
5,348,355 A * 9/1994 Oyha ..... E05B 83/16 292/11
5,667,260 A * 9/1997 Weyerstall ..... 292/201
5,715,713 A * 2/1998 Aubry et al. ..... 70/277
5,738,393 A * 4/1998 Chao ..... E05B 83/24 292/216
5,765,884 A * 6/1998 Armbruster ..... E05B 81/20 292/1
5,769,468 A * 6/1998 Armbruster ..... 292/201
5,915,766 A * 6/1999 Baumeister ..... B04B 7/06 292/201
5,931,034 A * 8/1999 Fisher ..... 70/264
6,012,747 A * 1/2000 Takamura ..... B60N 2/366 292/210
6,092,845 A * 7/2000 Koenig ..... E05B 83/16 292/225
6,106,033 A * 8/2000 Ruckert ..... E05B 83/16 292/216
6,109,079 A * 8/2000 Ikeda ..... E05B 81/06 292/201
6,123,371 A * 9/2000 Fisher ..... 292/216
6,149,210 A * 11/2000 Hunt ..... E05B 83/16 292/216
6,168,216 B1 * 1/2001 Nakajima et al. ..... 292/201
6,367,296 B1 * 4/2002 Dupont ..... 70/257
6,382,686 B1 * 5/2002 Ishigaki et al. ..... 292/201
6,485,071 B2 * 11/2002 Schwaiger ..... E05B 83/16 292/216
6,499,776 B2 * 12/2002 Takamura ..... E05B 81/20 292/201
6,547,291 B1 * 4/2003 Schwaiger ..... E05B 83/16 292/109
6,575,507 B2 * 6/2003 Reddmann ..... E05B 81/14 292/201
6,648,380 B1 * 11/2003 Szablewski ..... E05B 81/14 292/201
6,695,360 B1 * 2/2004 Forsell ..... E05B 83/16 292/201
6,886,869 B2 * 5/2005 Martinez ..... E05B 17/0029 292/129
6,986,534 B2 * 1/2006 Fisher ..... 292/216
7,125,057 B2 * 10/2006 Coleman ..... E05B 77/26 292/201
7,204,526 B2 * 4/2007 Seo ..... E05B 83/24 292/24
7,261,337 B2 * 8/2007 Nakagome ..... E05B 83/24 292/216
7,452,013 B2 * 11/2008 Kachouh ..... E05B 49/00 292/201
7,559,399 B2 * 7/2009 Lewis ..... B60R 21/38 180/274
8,360,483 B2 * 1/2013 Koppel ..... E05B 83/16 292/216
8,419,114 B2 * 4/2013 Fannon et al. ..... 296/193.11
8,882,160 B2 * 11/2014 Kamata ..... B60N 2/366 292/216
8,955,889 B2 * 2/2015 Bendel ..... E05B 81/20 292/200
8,974,641 B2 * 3/2015 Weber ..... B65D 43/164 202/201
2003/0127866 A1 * 7/2003 Martinez ..... E05B 17/0029 292/216
2005/0194792 A1 * 9/2005 Lomicka ..... E05B 15/0053 292/96
2006/0226661 A1 * 10/2006 Moore ..... 292/216
2007/0246944 A1 * 10/2007 Sundararajan ..... B60R 21/38 292/92
2008/0174125 A1 * 7/2008 Lomicka ..... E05B 15/0053 292/121
2008/0238109 A1 * 10/2008 Huang ..... E04B 1/6183 292/95
2011/0169279 A1 * 7/2011 Ishikawa ..... B60N 2/01583 292/96
2012/0049543 A1 * 3/2012 Park ..... E05B 83/24 292/220
2012/0074715 A1 * 3/2012 Kim ..... B60R 21/34 292/201
2012/0280519 A1 * 11/2012 Hong ..... E05B 83/24 292/128
2013/0049403 A1 * 2/2013 Fannon ..... E05B 83/24 296/193.11
2013/0076045 A1 * 3/2013 Torka ..... E05B 77/36 292/96

FOREIGN PATENT DOCUMENTS

EP 2573300 A2 * 3/2013 ..... E05B 77/36
JP 2005-22435 A 1/2005
KR 1999-018609 A 3/1999
KR 10-1154318 B1 6/2012

* cited by examiner

2-STEP GUIDE HOOD LATCH APPARATUS FOR VEHICLE

CROSS-REFERENCE TO RELATED APPLICATION

The present application claims priority of Korean Patent Application Number 10-2012-0092809 filed on Aug. 24, 2012, the entire contents of which application is incorporated herein for all purposes by this reference.

BACKGROUND OF INVENTION

1. Field of Invention

The present invention relates to a 2-step guide hood latch apparatus for a vehicle, by which a user may be provided with convenience in opening a hood merely with a simple manipulation inside a vehicle.

2. Description of Related Art

While vehicles have been recognized and developed as a simple transportation means or carrying equipment, technological competition to meet various demands by the customers become more fierce with the diversification in consumers' tastes.

Recently, vehicles have been evolved to shift their main focus from providing better exterior shapes and designs into provision of more advanced conveniences and control-related facilities.

In order to secure product competitiveness over rival car manufacturers in the global market as well as in the domestic market, a 2-step open hood system has been developed by Hyundai Motor Company and Kia Motors Corporation.

A hood is generally locked in two steps by using a safety lever so that when a release lever is manipulated inside a vehicle to release the locked hood, one step binding release is conducted by a cable operation, and in front of the vehicle, a driver puts the hand into an engine room to release the safety lever, whereby the hood is opened. In this way, a two-step safety device is provided for hood operations.

This structure is intended to meet vehicle safety standards regulations, and a firm hood latch should be installed in the vehicle's hood. For a vehicle in which a hood is opened or closed forward and the hood, if opened during driving, may obstruct a driver's field of vision, the vehicle is regulated by law to have 2-step lock or 2-spot lock.

FIG. 1 is an operating state diagram of a general hood latch apparatus for describing a method for releasing the hood latch apparatus. As shown in the first cut, an initial state, a hood striker 5 is locked in 2 steps by a claw 1 and a hook 2.

As shown in the second cut, once a driver manipulates a release lever disposed in an indoor driver's seat side, a pawl 4 is pulled in a direction indicated by an arrow and is rotated, thus releasing a binding force applied to the claw 1.

Next, as shown in the third cut, as the claw 1 is rotated, the striker 5 leaves an insertion groove 1*a* of the claw 1, such that the hood is slightly lifted from a primary lock state into a primary open state.

As shown in the fourth cut, the driver goes out of the vehicle and puts the hand into the primarily-opened hood to push a safety lever 3 in a direction indicated by an arrow, such that the hook 2 connected with the safety level 3 is rotated and thus the binding force which holds the hood striker 5 is released. Thus, the hood changes from the secondary locked state into the secondary open state.

However, to open the hood, the driver inevitably experiences the cumbersome process of manipulating the release lever indoors for primary lock release and putting the hand into the hood outdoors to manipulate the safety level 3.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made to solve the foregoing problem, and provides a 2-step guide hood latch apparatus for a vehicle, in which by removing a conventional safety lever, a driver can open a hood merely with two times of manipulation of a release handle indoors without going out of the vehicle, thereby solving the conventional inconvenience of having to put the hand into the hood and manipulate the safety lever.

According to an aspect of the present invention, there is provided a 2-step guide hood latch apparatus for a vehicle, the 2-step guide hood latch apparatus including a pawl rotatably mounted on a base plate, a claw rotatably mounted on the base plate in such a way to be held with the pawl, and a guide lever, an end portion of which is hinge-coupled to the pawl by a hinge structure, and a center portion and the other end portion of which are coupled to the claw to induce 1-step lock and 2-step lock states of the claw, in which a hood is opened merely with manipulation of a release lever indoors.

In particular, the guide lever may include a primary guide groove formed in a center thereof, the primary guide groove may be slidably coupled by insertion of a primary guide protrusion formed in the claw, primary, secondary, and tertiary holding ends may be formed in a bottom end, a center, and a top end of the primary guide groove, and the primary guide protrusion may be sequentially held in the holding ends, such that a 2-step lock function of the hood is performed.

The guide lever may include a secondary guide groove formed to lean to a side, the secondary guide groove may be slidably coupled by insertion of a secondary guide protrusion formed on the claw, and as the secondary guide protrusion moves to the left end or to the right end of the primary guide groove, the 2-step lock function of the hood may be assisted.

The primary guide groove of the guide lever may be continuously formed upwardly from a center in a longitudinal direction by hole processing, the primary holding end may be disposed on a bottom left end of the primary guide groove, the secondary holding end may be disposed in a center of a groove extending to the right from the primary holding end and then diagonally upwardly to the left, and the tertiary holding end may be disposed in a top end of a groove extending diagonally upwardly to the right from the secondary holding end, such that movement of the primary guide protrusion of the claw is guided.

The claw may have a primary holding protrusion and a secondary holding protrusion in a center and a bottom end thereof, and as the primary holding protrusion and the secondary holding protrusion are sequentially held in the stop protrusion portion of the pawl in 2-step opening, the 2-step lock function of the hood may be performed.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, the present invention will be described in detail with reference to the accompanying drawings to allow those of ordinary skill in the art to easily carry out the present invention.

Figure 1:
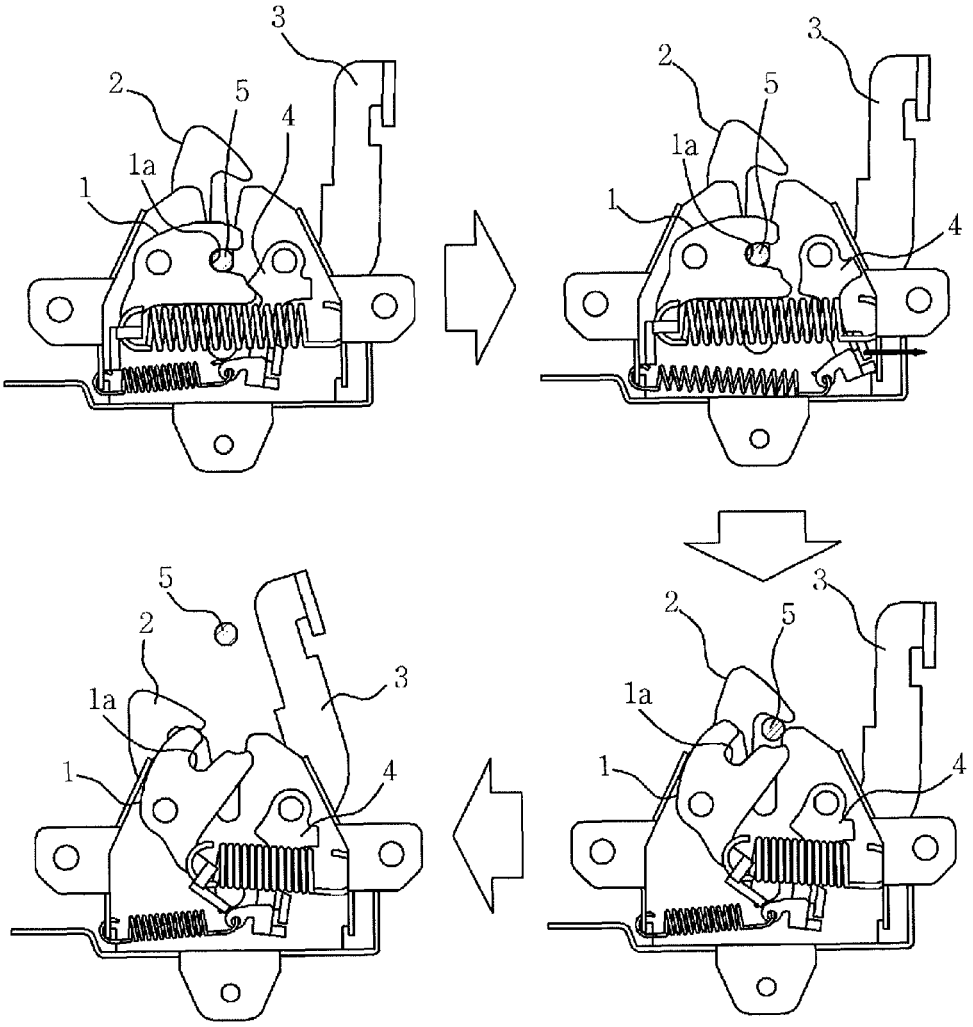
FIG. 1 is an operating state diagram of an exemplary general hood latch apparatus for describing a method for releasing the hood latch apparatus.
Figure 2A:
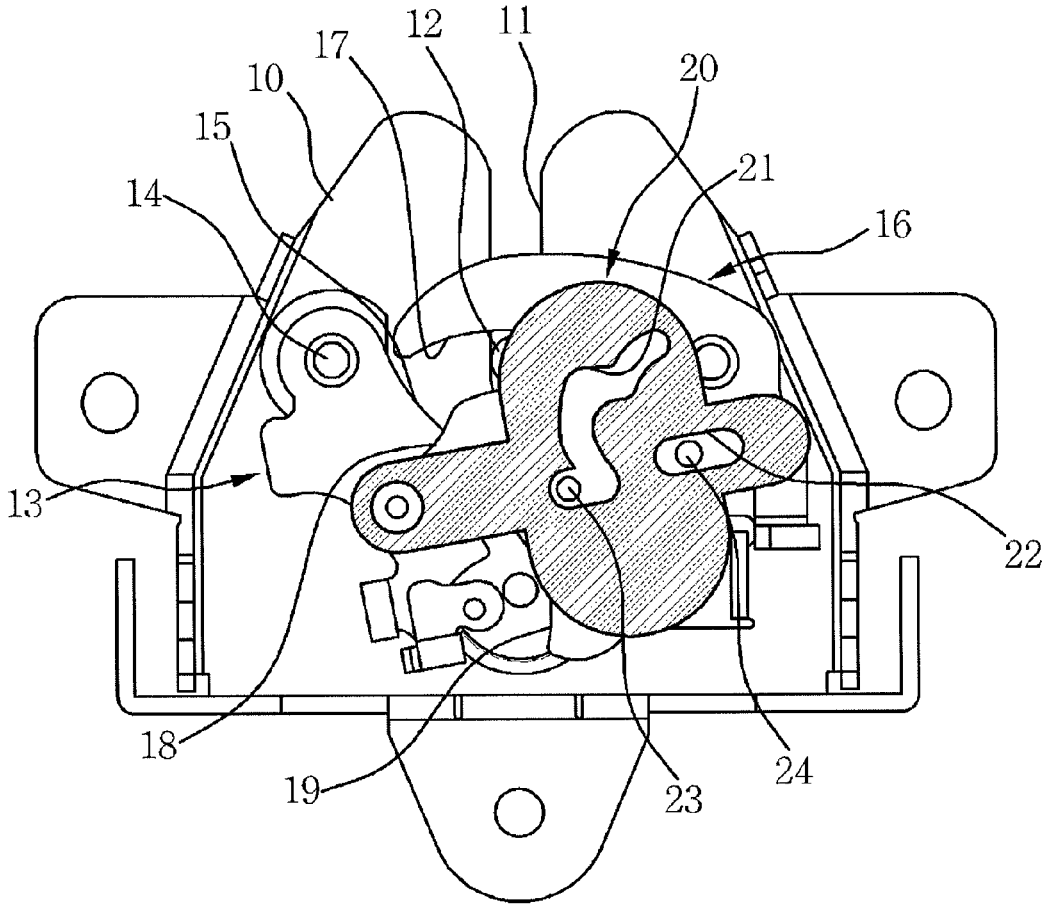
FIGS. 2A through 2E are exemplary operating state diagrams sequentially showing an open state from a closed state of a 2-step guide hood latch apparatus according to the present invention.
Figure 2B:
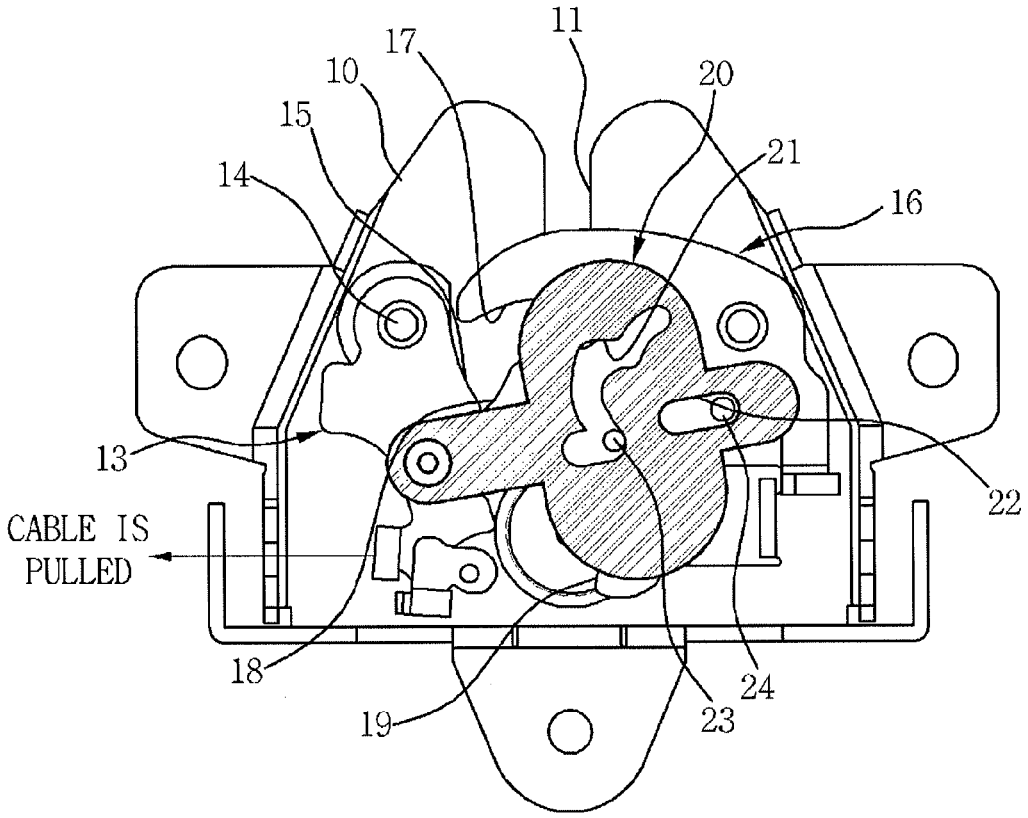
Figure 2C:
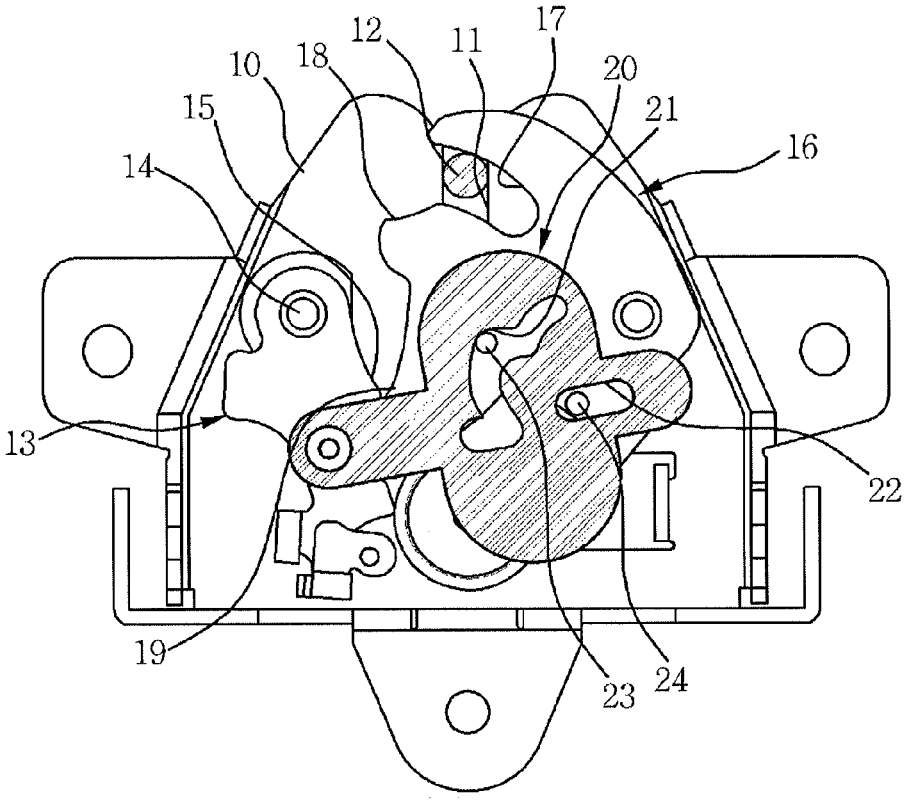
Figure 2D:
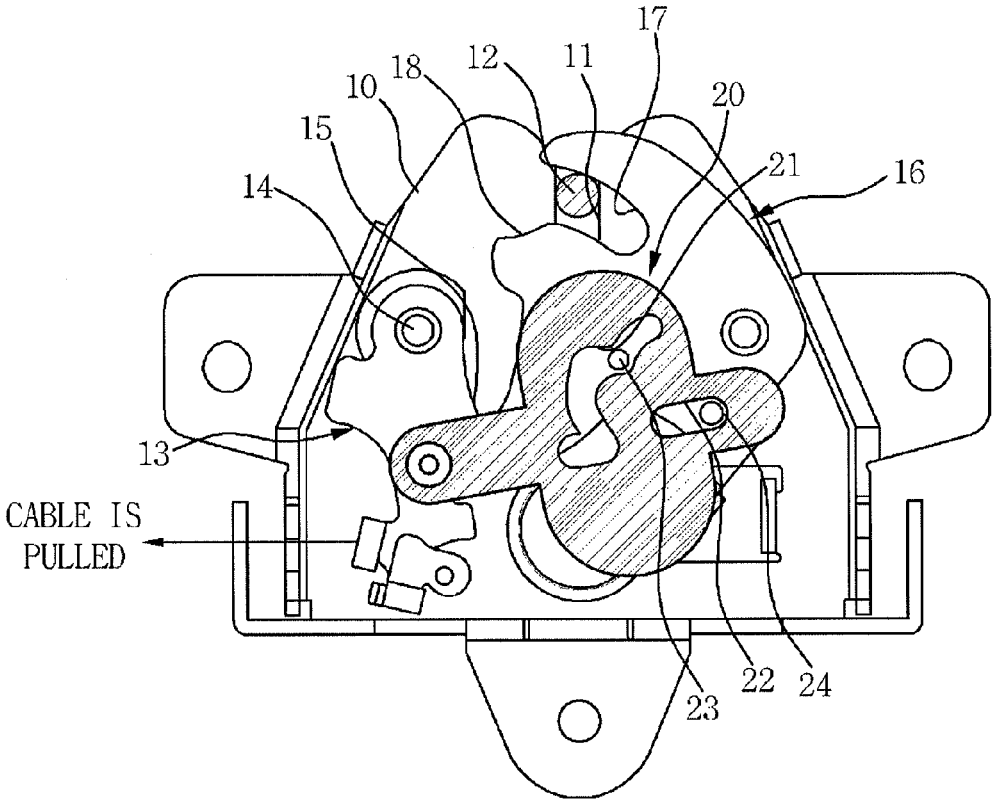
Figure 2E:
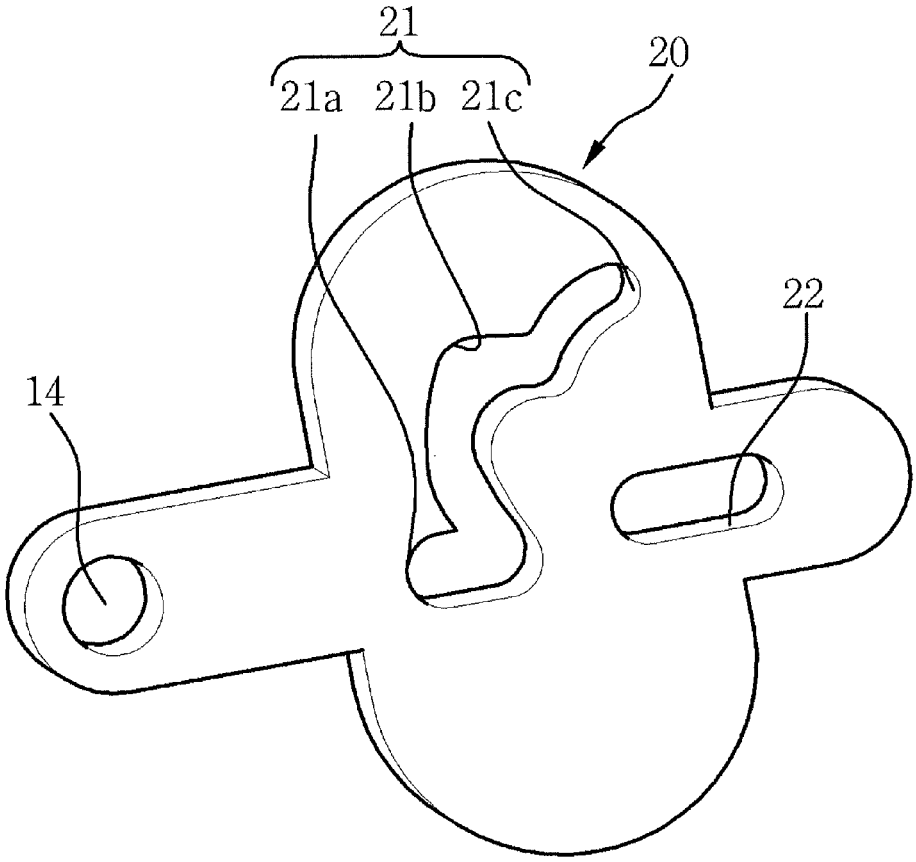

FIGS. 2A through 2E are operating state diagrams sequentially showing an open state from a closed state of a 2-step guide hood latch apparatus according to various embodiments of the present invention.

The present invention relates to a 2-step guide hood latch apparatus for a vehicle, by which 2-step unlock is possible indoors, for example, from within the interior passenger compartment, thus improving productivity.

The 2-step guide hood latch apparatus according to the present invention removes a conventional safety lever and includes a 2-step lock function in a latch by using a guide lever 20, thereby releasing 2-step lock with a release handle indoors.

The 2-step guide hood latch apparatus according to the present invention includes a base plate 10, a pawl 13 and a claw 16 mounted on the base plate 10 to rotate while facing each other, and a guide lever 20 which connects the pawl 13 and the claw 16 to achieve 1-step and 2-step lock functions.

The base plate 10 is installed to stand vertically in a front end portion of an engine room body opened or closed by a hood, such that the base plate 10 connects main parts of the hood latch apparatus and supports them to allow them to function properly.

An insertion groove 11 is formed directly downwardly from a top-end center portion to allow a U-shape hood striker installed in a front end portion of the hood to be inserted thereinto when the hood is closed.

The pawl 13 and the claw 16 are installed to rotate with a hinge structure on a front surface of the base plate 10.

For example, a top end portion of the pawl 13 is hinge-coupled to a left side of the base plate 10 by a first hinge shaft 14, such that a bottom end portion of the pawl 13 rotates with respect to the first hinge shaft 14 to the left or to the right.

In the first hinge shaft 14 on the top end of the pawl 13 is axially installed a first spring, an end portion of which is coupled to the base plate 10 and the other end portion of which is coupled to a fixing protrusion protruding from the bottom end of the pawl 13, such that once an external force is released after the bottom end portion of the pawl 13 is rotated by the external force, the bottom end portion of the pawl 13 moves to the original position by an elastic restoring force of the first spring.

The bottom end portion of the pawl 13 moves to the right toward the claw 16 by the first spring.

A right end portion of the claw 16 is hinge-coupled to the right side of base plate 10 by a second hinge shaft, such that the top end portion and the bottom end portion of the claw 16 are rotated with respect to the second hinge shaft to the left and to the right.

In the second hinge shaft on the right top end of the claw 16 is axially installed a second spring whose structure and function are the same as those of the first spring, but the end portions of the claw 16 move to the right by the second spring.

On the bottom end portion of the pawl 13 is formed the fixing protrusion to which a cable is connected. The cable is connected to a release handle which can be manipulated by a driver.

A stop protrusion portion 15 is formed in the center of the right side of the pawl 13, such that the stop protrusion 15 is situated on a rotation radius of the claw 16 and a portion of the claw 16 is stopped by the stop protrusion portion 15.

A holding groove 17 is formed to be recessed in the claw 16 in a direction from the left end portion thereof to the right side thereof, and when a hood striker 12 is inserted into the holding groove 17, the hood can maintain its closed state.

A primary holding protrusion 18 protrudes from the center of the claw 16, and is a portion which first contacts the hood striker 12 when the hood striker 16 contacts the claw 16 during state change of the hood to the closed state from the opened state. When locking is released by the release handle, a portion which is first stopped by the stop protrusion portion 15 of the pawl 13 is also the primary holding protrusion 18.

A secondary holding protrusion 19 protrudes from the bottom end portion of the claw 16, and is a portion which is secondarily stopped by the stop protrusion portion 15 after release of stop of the primary holding protrusion 18 when the hood is opened from the closed state.

A fixing protrusion protrudes from the right bottom end of the claw 16, and the other end portion of the second spring is fixed to the fixing protrusion.

Herein, to give 1-step and 2-step lock functions to the claw 16, a guide lever 20 is provided.

The guide lever 20 is coupled to the pawl 13 and the claw 16 at both end portions thereof, respectively, such that 1-step and 2-step lock states of the hood striker 12 can be maintained.

An end portion of the guide lever 20 is hinge-coupled to the pawl 13, and the other end portion of the guide lever 20 is coupled to the claw 16 through a secondary guide groove 22.

The guide lever 20 has a primary guide groove 21 and a secondary guide groove 22 in the right side to maintain 1-step lock and 2-step lock states between the pawl 13 and the claw 16, and the secondary guide groove 22 assists the primary guide groove 21.

The claw 16 has a primary guide protrusion 23 and a secondary guide protrusion 24 which protrude to be inserted into the primary guide groove 21 and the secondary guide groove 22, respectively.

The primary guide groove 21 is formed in the center of the guide lever 20 in a top to bottom direction from the left to the right through hole processing, is formed to lean slightly to the left upwardly from the right end, is formed from the left top end to the right, and then is further formed to the right in the direction of 2 o'clock. A primary holding end 21*a* is positioned on the left bottom end of the primary guide groove 21, a secondary holding end 21*b* is positioned on the left top end of the primary guide groove 21, and a tertiary holding end 21*c* is positioned on the right top end of the primary guide groove 21.

The primary guide protrusion 23 protrudes downwardly away from an inner end portion of the holding groove 17 of the claw 16 to be inserted into the primary guide groove 21 of the guide lever 20. When the primary guide protrusion 23 moves along the primary guide groove 21, primary locking is made in the primary holding end 21*a*, secondary locking is made in the secondary holding end 21*b*, and secondary opening is made in the tertiary holding end 21*c*.

The secondary guide groove 22 is positioned to lean to the right side of the guide lever 20, and is formed linearly along a longitudinal direction of the guide lever 20.

The secondary guide protrusion 24 is inserted into the secondary guide groove 22 to move to the left and to the right along the secondary guide groove 22, and assists the operation of the primary guide protrusion 23 to maintain a 2-step lock state.

Herein, the primary guide protrusion 23 is held in the primary holding end 21*a* positioned in the bottom left side of the primary guide groove 21, such that the primary lock state is maintained in the hood's closed state. In one time of release handle manipulation, the primary guide protrusion 23 is held in the secondary holding end 21*b* positioned in the top left side of the primary guide groove 21, such that the secondary lock state and the primary open state are maintained when the hood is opened. In two times of release handle manipulation, the primary guide protrusion 23 is held in the tertiary holding end 21*c* positioned in the top right side of the primary guide groove 21, thereby inducing the complete opening of the hood (the 2-step open state).

The operating state of the 2-step guide hood latch apparatus according to the present invention structured as described above will be described below.

As the driver opens the hood by handling the release handle two times inside a vehicle, the inconvenience of having to going out of the vehicle and manipulating a safety lever to release the 2-step lock state is resolved, thereby securing safety and providing convenience in manipulation for opening the hood.

1) One Time of Release Handle Manipulation

If the driver, when stopping the vehicle for repair and check for an engine room, pulls the release handle disposed on the driver's seat to open the hood, then the bottom end portion of the pawl 13 connected via the cable is pulled and rotated, and the primary holding protrusion 18 of the claw 16 is released from the primary lock state by rotation of the stop protrusion portion 15 of the pawl 13.

Due to the release of the primary holding protrusion 18, the claw 16 is rotated to the original position by an elastic restoring force of the second spring, and the secondary holding protrusion 19 of the claw 16 is held by the stop protrusion portion 15 of the pawl 13. As the primary guide protrusion 23 of the claw 16 is held by the primary holding end 21*a* while moving along the primary guide groove 21 of the guide lever 20, the secondary lock state and the primary open state can be maintained during opening of the hood.

In this state, if the release handle is pulled once and then released, then the bottom end portion of the pawl 13 rotates to the original position (to the right) by the elastic restoring force of the first spring.

The secondary guide protrusion 24 of the claw 16 slides from the right end to the left end of the secondary guide groove 22 of the guide lever 20, thus restricting the moving path of the primary guide protrusion 23 with the length of the secondary guide groove 22.

In other words, when the primary guide protrusion 23 moves along the primary guide groove 21 of the guide lever 20, the secondary guide protrusion 24 assists the primary guide protrusion 23 to be held in the secondary holding end 21*b*, thereby preventing the primary guide protrusion 23 from moving directly to the tertiary holding end 21*c* from the primary holding end 21*a*, and thus securing performance of 1-step lock and 2-step lock functions based on the primary guide protrusion 23.

2) Two Times of Release Handle Manipulation

Once the driver pulls the release handle in succession one more time to completely open the hood, the bottom end portion of the pawl 13 connected through the cable is pulled again and rotated, such that the secondary holding protrusion 19 of the claw 16 is released from the secondary lock state by rotation of the stop protrusion portion 15 of the pawl 13.

Next, due to the release of the secondary holding protrusion 19, the claw 16 is rotated to the original position by the elastic restoring force of the second spring, and the primary guide protrusion 23 of the claw 16 leaves the secondary holding end 21*b* of the primary guide groove 21 and moves to the tertiary holding end 21*c*, thus being stopped, and the hood striker 12 completely leaves the holding groove 17 of the claw 16, thus being changed into a 2-stage open state, such that the hood is opened.

Therefore, according to the present invention, the guide lever 20 is disposed on the same vertical plane in front of the pawl 13 and the claw 16 to connect the pawl 13 and the claw 16, and the primary guide protrusion 23 of the claw 16 is stepwise held by using the primary guide groove 21 formed in the guide lever 20, such that a 2-step lock function is given to the guide lever 20, thereby easily opening the hood merely with manipulation of the release handle indoors and thus improving the productivity.

Since the hood may be opened with manipulation indoors, the driver does not need to go out of the vehicle and put the hand into the hood to release binding of the safety lever. Moreover, as the conventional safety lever is removed, walker protection performance in a vehicle crash can be improved.

The 2-step guide hood latch apparatus for a vehicle according to the present invention may have the following advantages:

first, the guide lever is disposed on the same vertical plane in front of the pawl and the claw to connect the pawl and the claw, and the primary guide protrusion of the claw is stepwise held using the primary guide groove formed in the guide lever, such that a 2-step lock function is given to the guide lever, thereby easily opening the hood merely with manipulation of the release handle indoors and thus improving the productivity; and second, since the hood may be opened with manipulation indoors, the driver does not need to go out of the vehicle and put the hand into the hood to release binding of the safety lever. Moreover, as the conventional safety lever is removed, walker protection performance in a vehicle crash can be improved.

For convenience in explanation and accurate definition in the appended claims, the terms front and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A two-step guide hood latch apparatus for a vehicle, the two-step guide hood latch apparatus comprising:

a pawl rotatably mounted on a base plate;

a claw rotatably mounted on the base plate and selectively engaged with the pawl, the pawl selectively restricting a rotation of the claw so as to perform a latch and lock function of a hood striker while the hood striker is selectively engaged with the pawl and claw; and a guide lever including a first end portion hingedly and directly coupled to the pawl by a hinge structure, and including a center portion and a second end portion directly coupled to the claw;

wherein the guide lever is continuously directly coupled to both the pawl and the claw and the guide lever is configured to move toward the pawl when the pawl is rotated, wherein the guide lever includes a primary guide groove formed in a center thereof, the primary guide groove being slidably coupled by insertion of a primary guide protrusion formed in the claw, and primary, secondary, and tertiary holding ends being formed in a bottom end, a center, and a top end of the primary guide groove, wherein the primary and secondary holding ends are configured to restrict a rotation of the claw by holding the primary guide protrusion in first and second holding states, wherein the first holding state between the primary holding end and the primary guide protrusion, and the second holding state between the secondary holding end and the primary guide protrusion are sequentially released by pulling a cable connected to the pawl, wherein the primary guide protrusion is guided along the primary guide groove from the primary holding end to the secondary holding end by the rotation of the claw when the first holding state is released by moving the guide lever due to the rotation of the pawl, and wherein the claw has a primary holding protrusion and a secondary holding protrusion in a center and a bottom end thereof, and as the primary holding protrusion and the secondary holding protrusion are sequentially held in a stop protrusion portion of the pawl in two-step opening, the two-step lock function of the hood is performed.

2. The two-step guide hood latch apparatus of claim 1, wherein the primary guide protrusion is sequentially held in the primary, secondary, and tertiary holding ends, such that the two-step lock function of the hood is performed.

3. The two-step guide hood latch apparatus of claim 1, wherein the guide lever comprises a secondary guide groove formed to lean to a side, the secondary guide groove is slidably coupled by insertion of a secondary guide protrusion formed on the claw, and as the secondary guide protrusion moves to the left end or to the right end of the secondary guide groove, the two-step lock function of the hood is assisted.

4. The two-step guide hood latch apparatus of claim 2, wherein the primary guide groove of the guide lever is continuously formed upwardly from a center in a longitudinal direction by hole processing, the primary holding end is disposed on a bottom left end of the primary guide groove, the secondary holding end is disposed in a center of a groove extending rightward from the primary holding end and then diagonally upwardly leftward, and the tertiary holding end is disposed in a top end of a groove extending diagonally upwardly rightward from the secondary holding end, such that movement of the primary guide protrusion of the claw is guided.

5. A two-step guide hood latch apparatus for a vehicle, the two-step guide hood latch apparatus comprising:

a pawl rotatably mounted on a base plate;

a claw rotatably mounted on the base plate and selectively engaged with the pawl, the pawl selectively restricting a rotation of the claw so as to perform a latch and lock function of a hood striker while the hood striker is selectively engaged with the pawl and claw; and a guide lever including a first end portion hingedly and directly coupled to the pawl by a hinge structure, and including a center portion and a second end portion directly coupled to the claw;

wherein the guide lever is continuously directly coupled to both the pawl and the claw and the guide lever is configured to move toward the pawl when the pawl is rotated, wherein the guide lever includes a primary guide groove formed in a center thereof, the primary guide groove being slidably coupled by insertion of a primary guide protrusion formed in the claw, and primary, secondary, and tertiary holding ends being formed in a bottom end, a center, and a top end of the primary guide groove, wherein the primary and secondary holding ends are configured to restrict a rotation of the claw by holding the primary guide protrusion in first and second holding states, wherein the first holding state between the primary holding end and the primary guide protrusion, and the second holding state between the secondary holding end and the primary guide protrusion are sequentially released by pulling a cable connected to the pawl, wherein the primary guide protrusion is guided along the primary guide groove from the primary holding end to the secondary holding end by the rotation of the claw when the first holding state is released by moving the guide lever due to the rotation of the pawl, wherein the primary guide protrusion is sequentially held in the primary, secondary, and tertiary holding ends, such that a two-step lock function of the hood is performed, and wherein the primary guide groove of the guide lever is continuously formed upwardly from a center in a longitudinal direction by hole processing, wherein the primary holding end is disposed on a bottom left end of the primary guide groove, wherein the secondary holding end is disposed in a center of a groove extending rightward from the primary holding end and then diagonally upwardly leftward, and wherein the tertiary holding end is disposed in a top end of a groove extending diagonally upwardly rightward from the secondary holding end, such that movement of the primary guide protrusion of the claw is guided.

* * * * *